US005437468A

United States Patent [19]

Schenner

[11] Patent Number: 5,437,468

[45] Date of Patent: Aug. 1, 1995

[54] SKI

[75] Inventor: Franz Schenner, Mittersill, Austria

[73] Assignee: Blizzard Ges.m.b.H., Mittersill, Austria

[21] Appl. No.: 997,388

[22] Filed: Dec. 28, 1992

[30] Foreign Application Priority Data

Feb. 13, 1992 [DE] Germany ..... 9201845 U

[51] Int. Cl.[6] ..... A63C 5/00

[52] U.S. Cl. ..... 280/602; 280/607; 280/618

[58] Field of Search ..... 280/607, 617, 618, 602, 280/601, 633

[56] References Cited

U.S. PATENT DOCUMENTS

| | | | |
|---|---|---|---|
| 4,141,570 | 2/1979 | Sudmeier | 280/607 |
| 4,505,494 | 3/1985 | Gertsch | 280/618 |
| 4,725,069 | 2/1988 | Stampacchia et al. | 280/607 |
| 4,896,895 | 1/1990 | Bettosini | 280/607 |
| 5,046,751 | 9/1991 | Scherubl | 280/607 |
| 5,129,668 | 7/1992 | Hecht | 280/607 |
| 5,135,250 | 8/1992 | Abondance et al. | 280/618 |

FOREIGN PATENT DOCUMENTS

| | | |
|---|---|---|
| 1270867 | 6/1990 | Canada . |
| 0182776 | 5/1986 | European Pat. Off. . |
| 2637192 | 6/1990 | France . |
| 9202987 U | 6/1992 | Germany . |

OTHER PUBLICATIONS

European Search Report.

*Primary Examiner*—Margaret A. Focarino
*Assistant Examiner*—Michael Mar
*Attorney, Agent, or Firm*—Morgan & Finnegan

[57] ABSTRACT

A ski comprises a body with a plate arranged thereon and which plate is connected pivotally with a bearing arrangement secured to the ski body. The plate is connected at one side through at least one pivot lever to the bearing arrangement and the pivot lever is acted upon by an adjustable spring force. The ski has an improved damping action, exhibiting stepless variation of the rigidity distribution and the surface pressure distribution, thus permitting achievement of desired running properties, as well as simple mounting or removal of the plate arrangement.

5 Claims, 8 Drawing Sheets

SKI

The invention relates to a ski with a plate arranged on the body thereof and which plate is connected pivotally with bearing means secured to the ski.

BACKGROUND OF THE INVENTION

There has already been a proposal, (see the European patent publication 0 437 172 A1), to arrange a mounting plate on a ski which is rigidly secured at one side and at the other side is guided for free motion in the longitudinal direction. Due to the free longitudinal guiding action the mounting plate serves to maintain the ability of the ski to flex.

In accordance with another proposal, (see the German patent publication 3,932,438), a plate-shaped support element is arranged to be held in bearing means. Due to such bearing means for the plate mounting the ski binding, there is only a small resistance to deformation of the ski, the result being that it is possible to attain a harmonious strain distribution and, consequently, continuous ski edge engagement along the entire length of the ski. Therefore, the properties are not permanently impaired by the ski binding.

However it can be desirable to provide for systematic adjustment of the rigidity of the ski adjacent to the binding.

Accordingly, one object of the present invention is to provide an improved ski of the type initially mentioned in which the rigidity distribution or, respectively, the surface pressure distribution can be systematically adjusted adjacent to the fitted ski binding.

Taking as starting point a ski of the type initially mentioned, this object is attained in accordance with the invention by connecting the plate at one side by means of at least one pivot lever which is provided with a bearing means fixed to the ski body and which pivot lever is able to be acted upon by means of an adjustable spring force.

The adjustable spring force is, in accordance with a preferred working embodiment of the invention, able to be produced by means of a helical spring arranged in the bearing means fixed to the ski and may be transmitted via a pin to the pivot lever. However in lieu of the helical spring it is possible to provide some other elastic element for producing the spring force.

The pre-tension of the helical spring may be steplessly varied using a screw bolt which is able to be adjusted by the skier using a suitable key or spanner, The pin with which the spring force is transmitted to the pivot lever may consist of a rigid material, but it is more advantageous for it to consist of an elastic material.

The plate may be fashioned to vary in form along its length, i.e., it may have different breadths along its length corresponding to different cross sections.

The bearing means secured to the ski may be covered by suitable cover means to prevent the respective joints from becoming clogged with snow and ice. In this respect it is an advantage for such covers to simultaneously secure the pivot pins of the pivotal bearing means of the plate and thus prevent the same from slipping out laterally.

The invention furthermore contemplates an arrangement in which the plate is extended at one side as far as, approximately, the shovel-shaped tip of the ski. In this respect the extended part of the plate is mounted at its free end so that it may slide longitudinally and pivotally in the bearing means.

Another advantageous feature of the invention is that at least in one of the bearing means a plurality of holes is provided on top of each other to receive the bearing pins with the result that the plate is able to be set at different heights. Due to the different levels at which the plate can be fitted it is possible to additionally influence the running properties of the ski due to the extension or shortening of the lever arm in relation to the ski edge.

An improved damping action having an advantageous effect on the running properties of the ski is possible, in accordance with a further form of the invention, provided an elastomeric element is arranged between the plate and the surface of the body of the ski and, which may in some cases be bonded to the surface of the ski.

The present invention makes it possible to steplessly vary the course of the rigidity distribution or, respectively, the surface pressure distribution in a ski in accordance with the desired running properties, in an advantageous manner. Due to the design in accordance with the invention, a system is made available which is particularly simple to replace, since after removal of the bearing pins the plate, with the binding mounted thereon, can be removed from the ski and mounted on another ski.

THE DRAWINGS

Further advantageous developments and convenient forms of the invention will be understood from the following detailed description of embodiments thereof taken in conjunction with the accompanying drawings wherein:

FIG. 1 is a diagram indicating the course of rigidity distribution or, respectively, surface pressure distribution in the case of customarily mounted ski bindings;

FIG. 2*a* and

FIG. 2*b* diagrammatically indicate the transfer of force in the part adjacent to the binding on the ski;

FIG. 3*a* and

FIG. 3*b* indicate the connection between the rigidity distribution and the surface pressure distribution;

FIG. 4*a* and

FIG. 4*b* are respectively detailed views of parts of the a ski in accordance with the invention;

FIG. 5 is a detailed view of the working embodiment of the ski in accordance with the invention as depicted in FIG. 4, showing the ski partially in seconds.

FIG. 6*a* and

FIG. 6*b* are overall views of the working embodiments illustrated in FIGS. 4 and 5 showing the ski in accordance with the invention adjacent to the bindings;

FIG. 7 is a diagram of the rigidity distribution of a ski in accordance with the invention with a binding mounted on a moving plate;

FIG. 8*a* and

FIG. 8*b* show a detail of the working embodiment of the ski in accordance with the invention under different conditions of loading.

FIG. 9 shows a further working embodiment of the present invention and diagrammatically the corresponding flexural rigidity;

FIG. 10*a* and

FIG. 10*b* are views of a third working embodiments of a ski in accordance with the invention.

DESCRIPTION OF THE PREFERRED EMBODIMENTS

Figure 1:
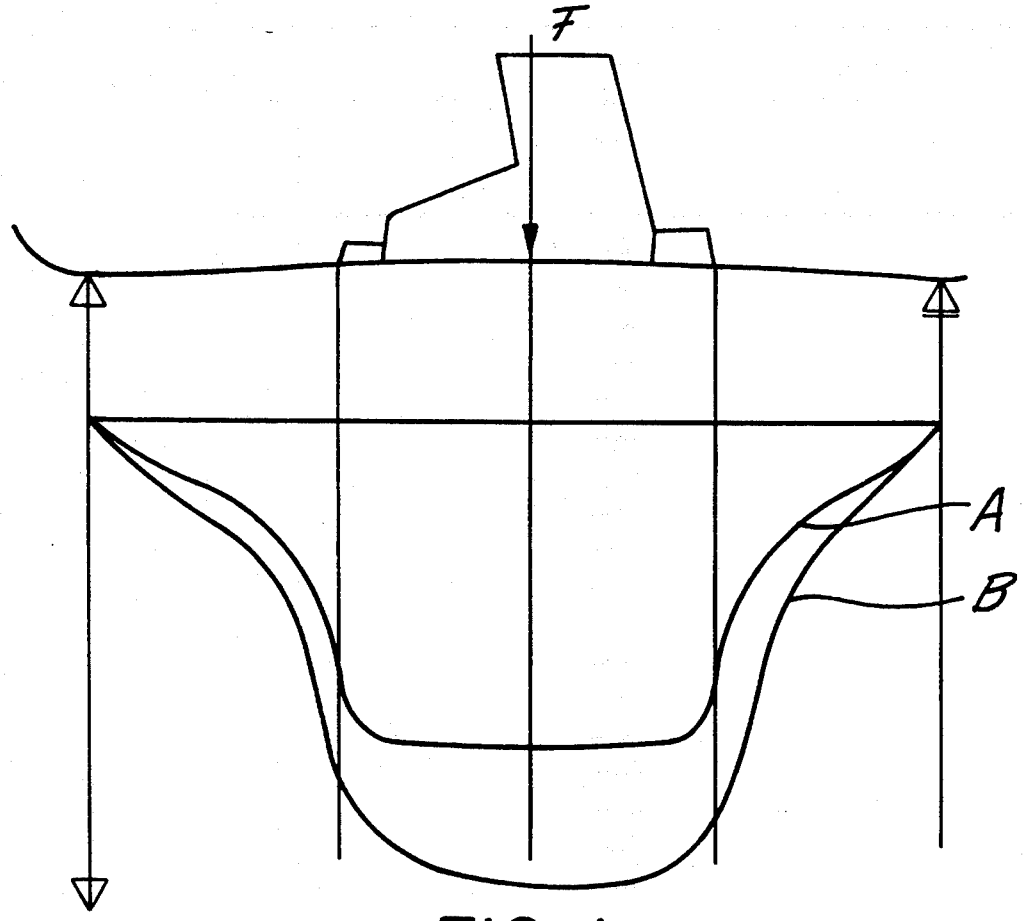

Turning now to FIG. 1, the course of rigidity distribution is indicated as A in the diagram underneath the stylized ski, whereas B indicates the course of surface pressure distribution along the length of the ski. The load placed on the ski by the skier is in the present case indicated by the force vector F. For customary skis with a correspondingly mounted binding it may be seen from this diagram that the stiffening of the ski underneath a ski boot has a clearly recognizable effect on the surface pressure distribution underneath the ski. The surface pressure distribution underneath the ski is for its part significant for the transmission of force and consequently for the control properties of the ski.

Figure 2A:
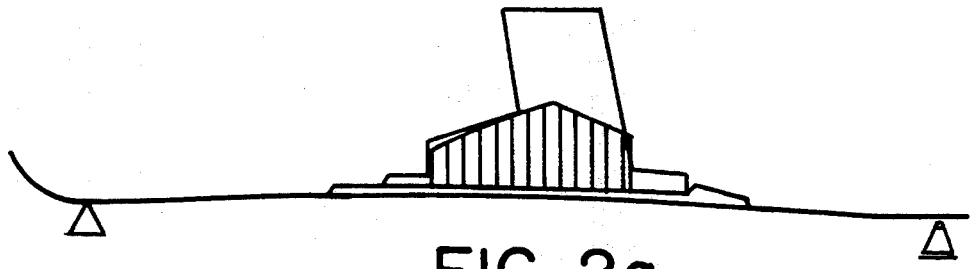
Figure 2B:
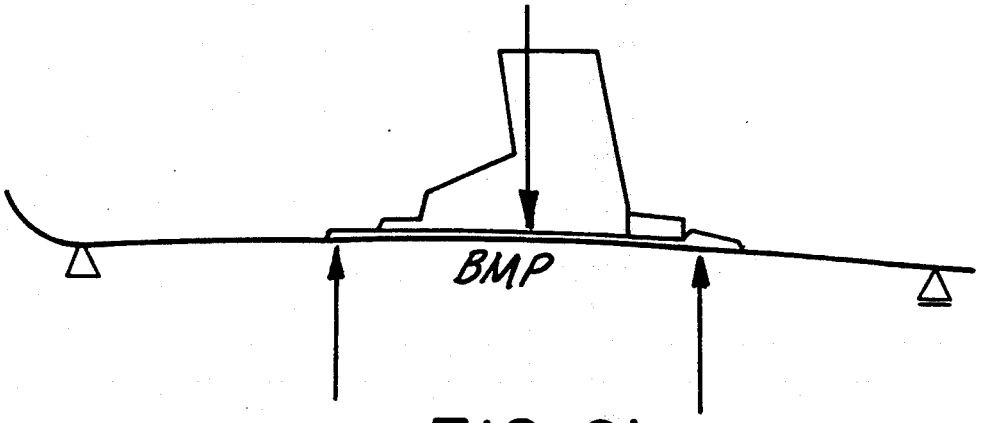

In the representation in accordance with FIG. 2*a* the transmission of force adjacent to the binding is indicated by the diagram drawn over the ski boot. The force is transmitted adjacent to the binding due to the weight of the body which is carried by the skier's legs. This surface force distribution may, as shown in FIG. 2*b*, be replaced by a resulting single force, which takes effect exactly at the point at which the binding is mounted, i. e. in the center of the ski binding part of the ski.

Figure 3A:
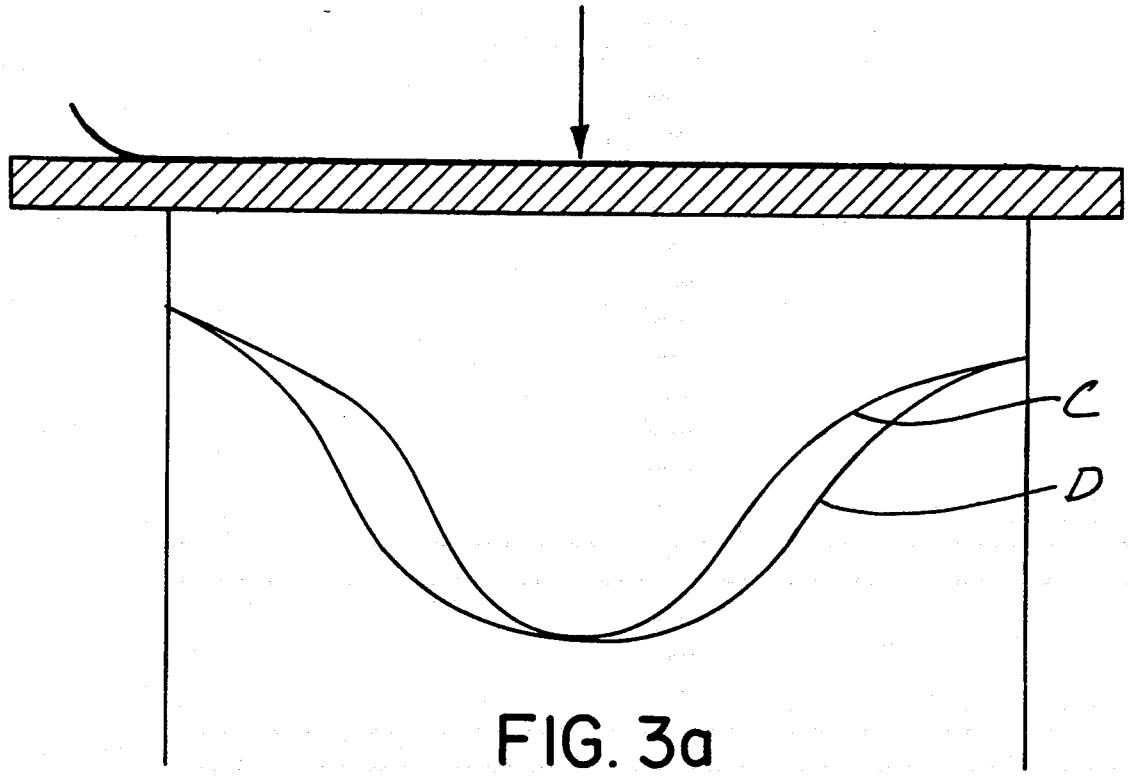
Figure 3B:
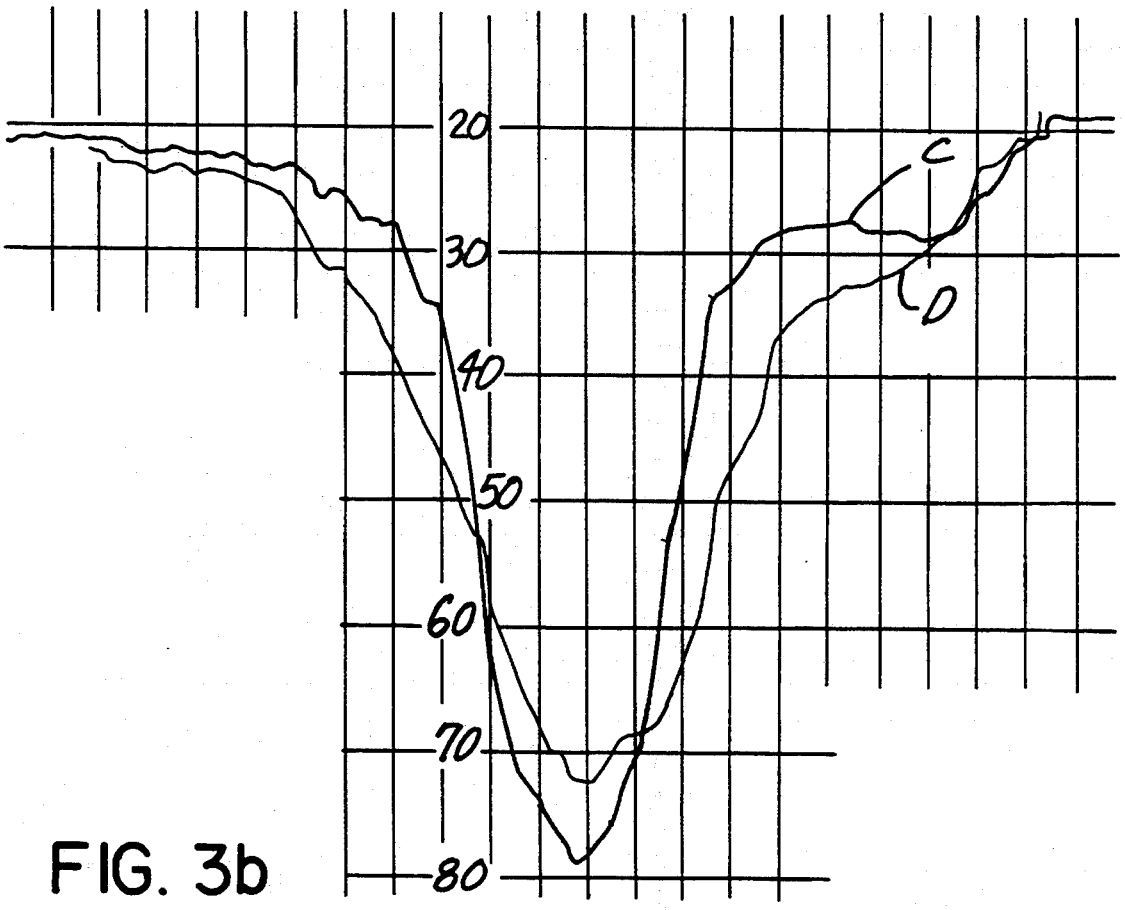

If, in a model test, the ski is now loaded at the position of the mounting of the binding, then in the case of the use of a customary ski without a binding there will generally be the curve C. D indicates the corresponding surface pressure distribution for a ski with a binding in the mounted condition. In FIG. 3*b* a corresponding log of measurements is shown, in which a corresponding load of 230N was applied. The log of measurements clearly shows that there is a broadening out of the surface pressure distribution in the case of a ski with a binding mounted thereon, (see curve D).

The surface pressure distribution for a ski on a rigid, even support is directly proportional to the rigidity distribution. This force transmission mechanism can be very satisfactorily examined using simple methods of measurement. The ski in accordance with the invention renders possible a systematic exploitation of the previously indicated relationships, as described in the above, for modification of the running properties of the ski.

Figure 4A:
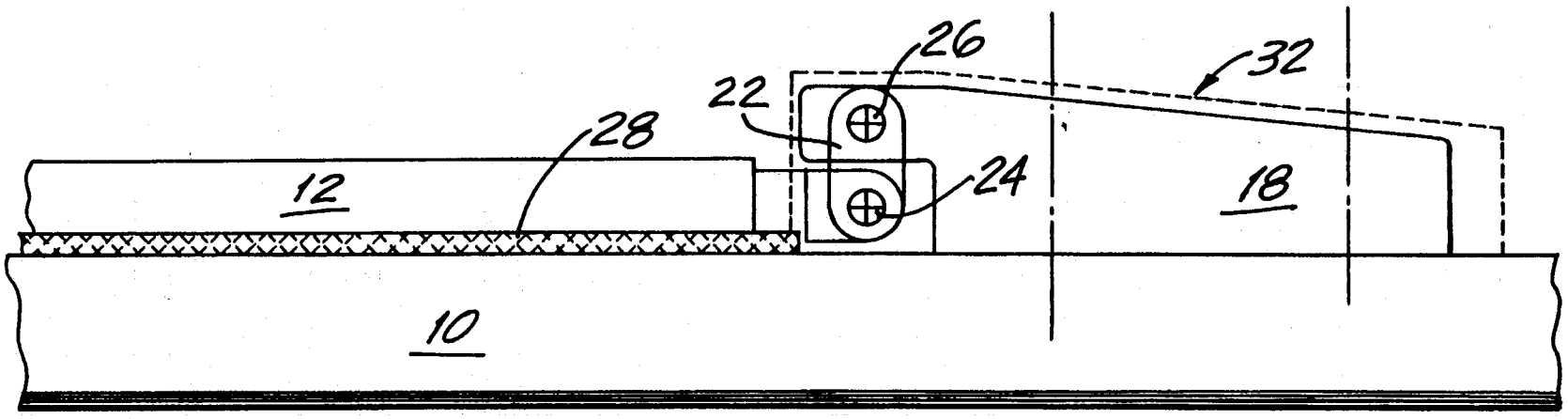
Figure 4B:
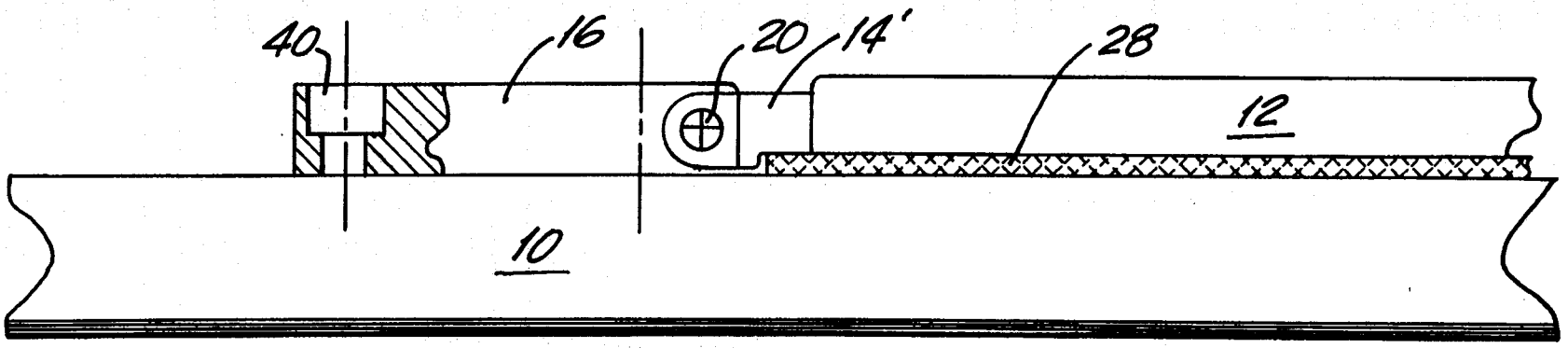

A first working embodiment will now be described in more detail with reference to FIGS. 4*a*, 4*b*, 5, 6*a* and 6*b*. On a ski body 10 of customary design two bearings 16 and 18 are stationarily arranged. These bearings may for instance consist of a reinforced thermoplastic synthetic resin, injection cast aluminum or may be milled aluminum components. The bearings 16 and 18 can be connected with the body of the ski by screws. In FIG. 4*b* a hole is depicted to receive a screw 40.

A plate 12 is pivotally journaled in the bearings 16 and 18. The plate 12 can consist of aluminum, or a sandwich structure of fiber-reinforced composite material with polyurethane cores, wood cores or honeycomb cores. The plate 12 has corresponding coupling elements 14 and 14' at its front and rear ends, the elements comprising corresponding through holes to receive securing pins 20 and 24. The coupling element 14' is pivotally mounted in the bearing 16 using a securing pin 20. The securing pin 20 is locked by a cover 30 as shown in broken lines in the Figures to prevent it from slipping out laterally. The cover 30 additionally protects the bearing 16 against the ingress of foreign matter. The coupling element 14 is, as more particularly shown in FIG. 6*b*, designed in the form of a fork. Between the fork-shaped parts of the coupling element 14 a pivotal lever 22 is journaled by means of pin 24, on its end facing the surface of the ski, in the bearing 18. A cover 32, which in the drawing is shown in broken lines, is slipped over the bearing 18. This cover also functions to prevent the pins 24 and 26 from slipping out sideways.

Figure 5:
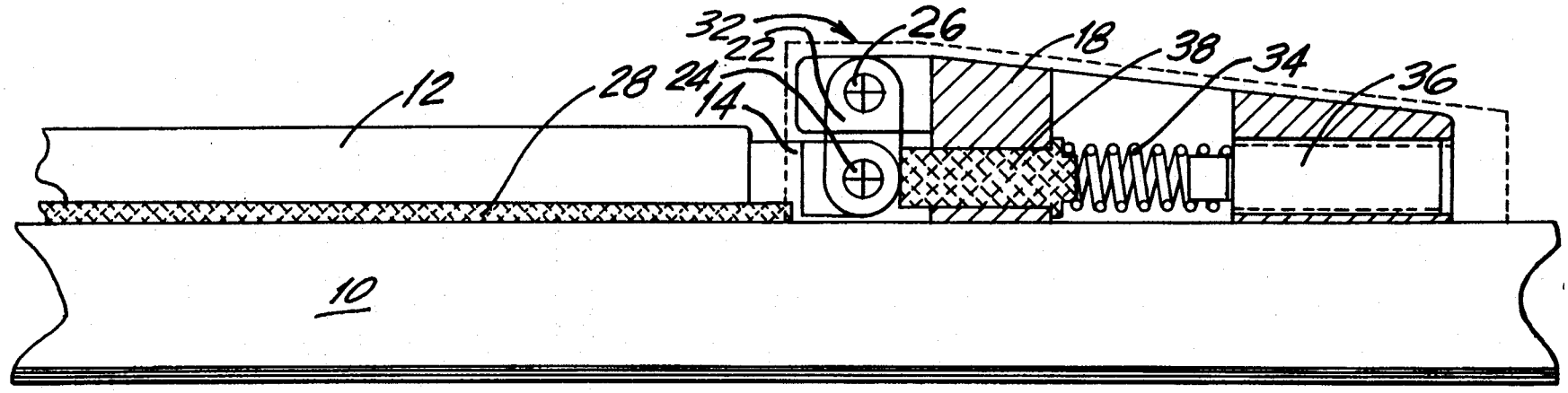
Figure 6A:
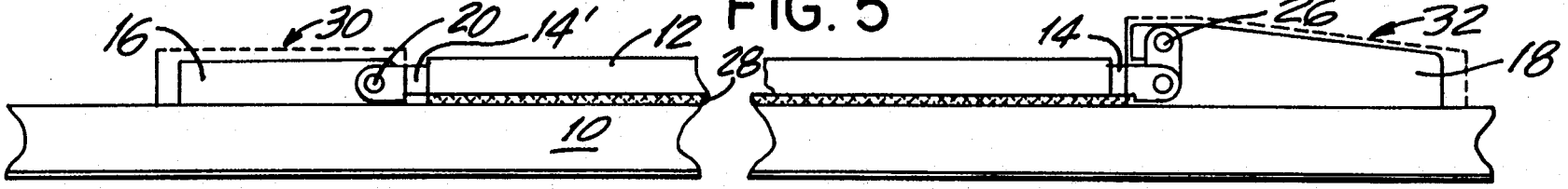
Figure 6B:
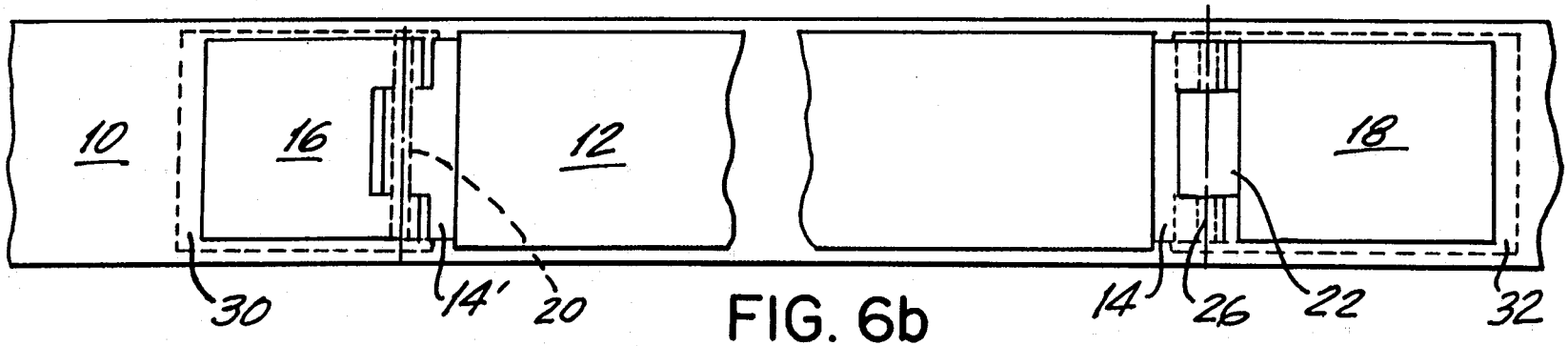

In FIG. 5 the bearing 18 is partly depicted in longitudinal section. Accordingly a helical spring 34 acts through the intermediary of a pin 38 opposite to the plate 12 on the pivotal lever 22. The pre-tension of the helical spring 34 is able to be adjusted using a screw pin 36. The pin 38 itself may again consist of an elastic material, or of flexurally rigid material. Therefore, it is possible for the spring characteristic of the overall system to be changed in a still further way.

Figure 8A:
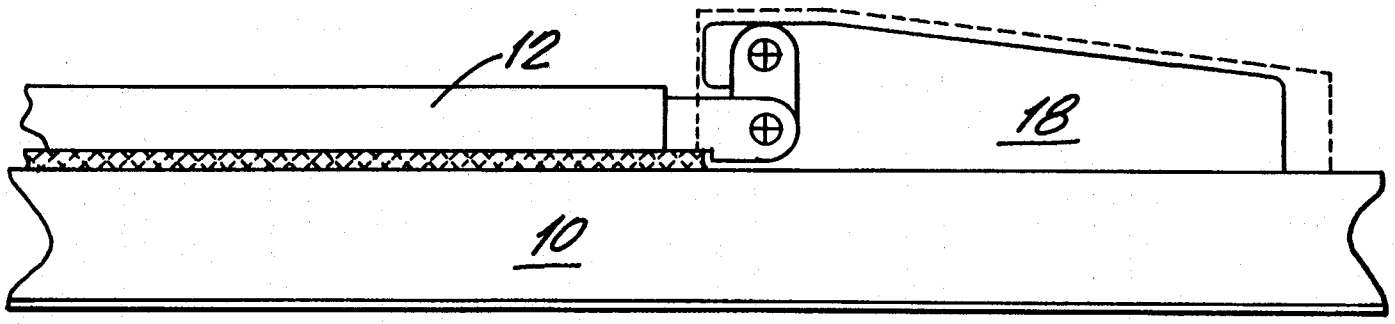
Figure 8B:
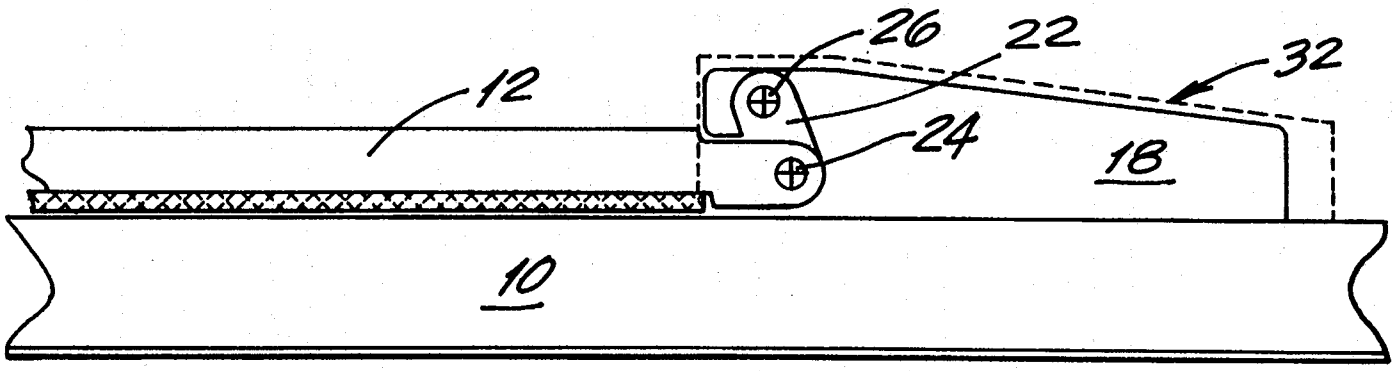

In FIGS. 8*a* and 8*b* the possible deflection of the pivotal lever 22 is shown in the case of corresponding relative movement of the plate 12 in relation to the body of the ski and with a corresponding flexure of the body 10 of the ski. The length ratios of the pivotal lever 22 are so selected that deflection is still possible even at the maximum flexure of the ski. Such maximum deflection is to be seen in FIG. 8*b*, whereas FIG. 8*a* shows the state when ski is not loaded. The deflection, depicted in FIG. 8*b*, of the pivotal lever 22 is opposed by the spring force, transmitted via the helical spring 34 and possibly via the pin 38 consisting of elastic material, of the deflection motion of the plate 12.

Figure 7:
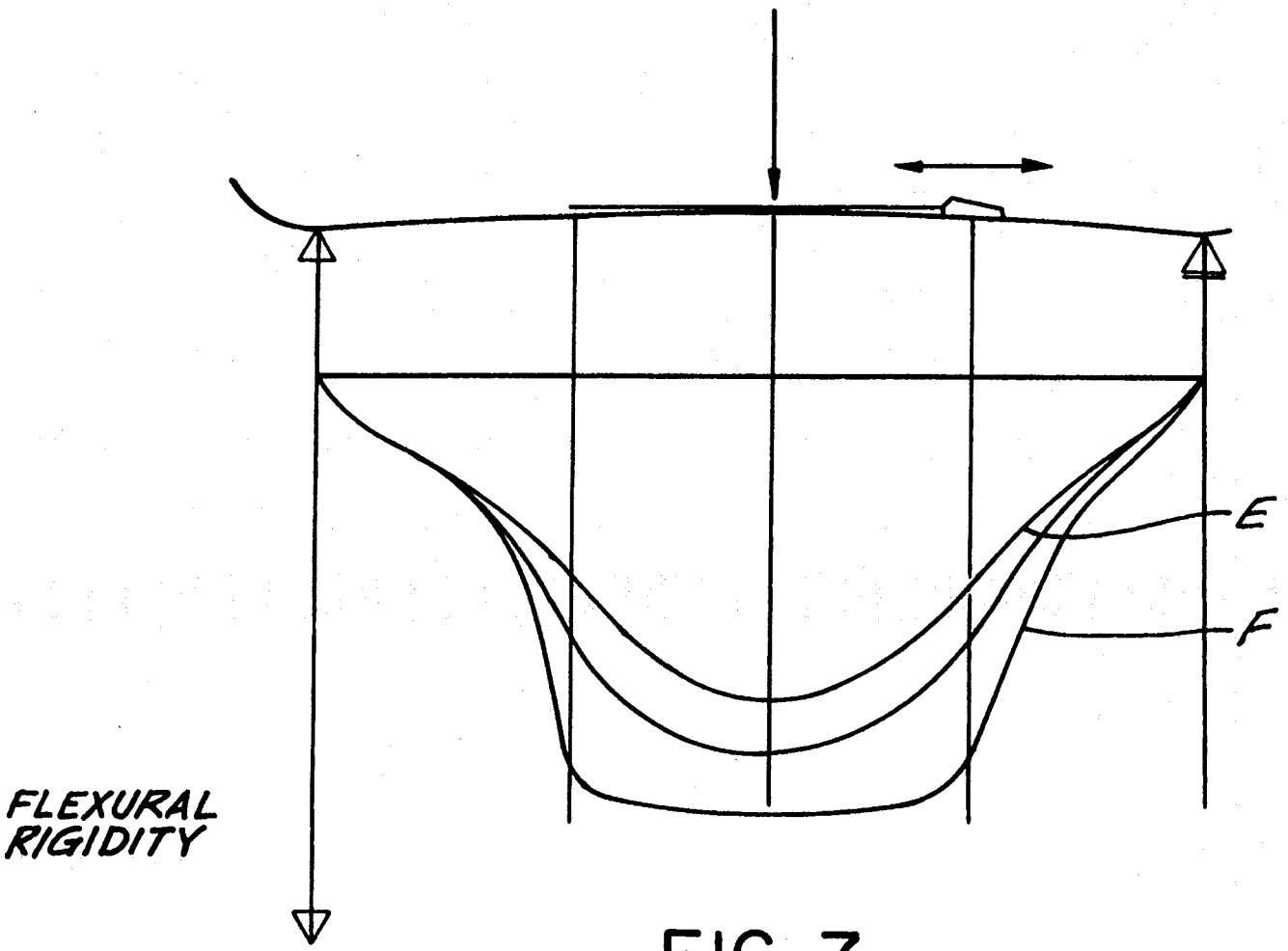

The diagram in accordance with FIG. 7 shows the different possibilities of adjustment for the ski in accordance with the invention, The diagram indicates the flexural rigidity, the curve E indicating the flexural rigidity with respect to a ski with a freely moving plate. Here we have the limiting case in which no spring force is acting on the pivotal lever. However, on the other hand, the curve F is for the flexural rigidity for a rigidly mounted plate 12, that is to say a plate 12, in the case of which the pivotal lever 22 is immovable. In this case the spring force of the helical spring 34 would be very large. As is indicated by the course of the curve between these two limiting curves in the diagram, it is possible for any desired flexural rigidity function to be produced by a suitable selection of the spring force applied by the helical spring 34 or, respectively, the adjustment of the pre-tension of the spring force using the screw 36. Therefore, it is possible to set the running properties of the ski ideally to different ski run conditions.

In accordance with the working embodiment described here it is possible for the plate 12 to be coupled with the ski using an elastic layer or plate 28 with the result that impacts and vibrations, which occur in the vertical direction, can be damped. The layer or plate 28 can be bonded to the body 10 of the ski. However it is furthermore necessary to allow for sliding of the plate 28. Preferably the layer or plate 28 is however freely supported on the ski. The elastic layer or plate 28, furthermore performs a sealing function between the body 10 of the ski and the plate 12.

Figure 9:
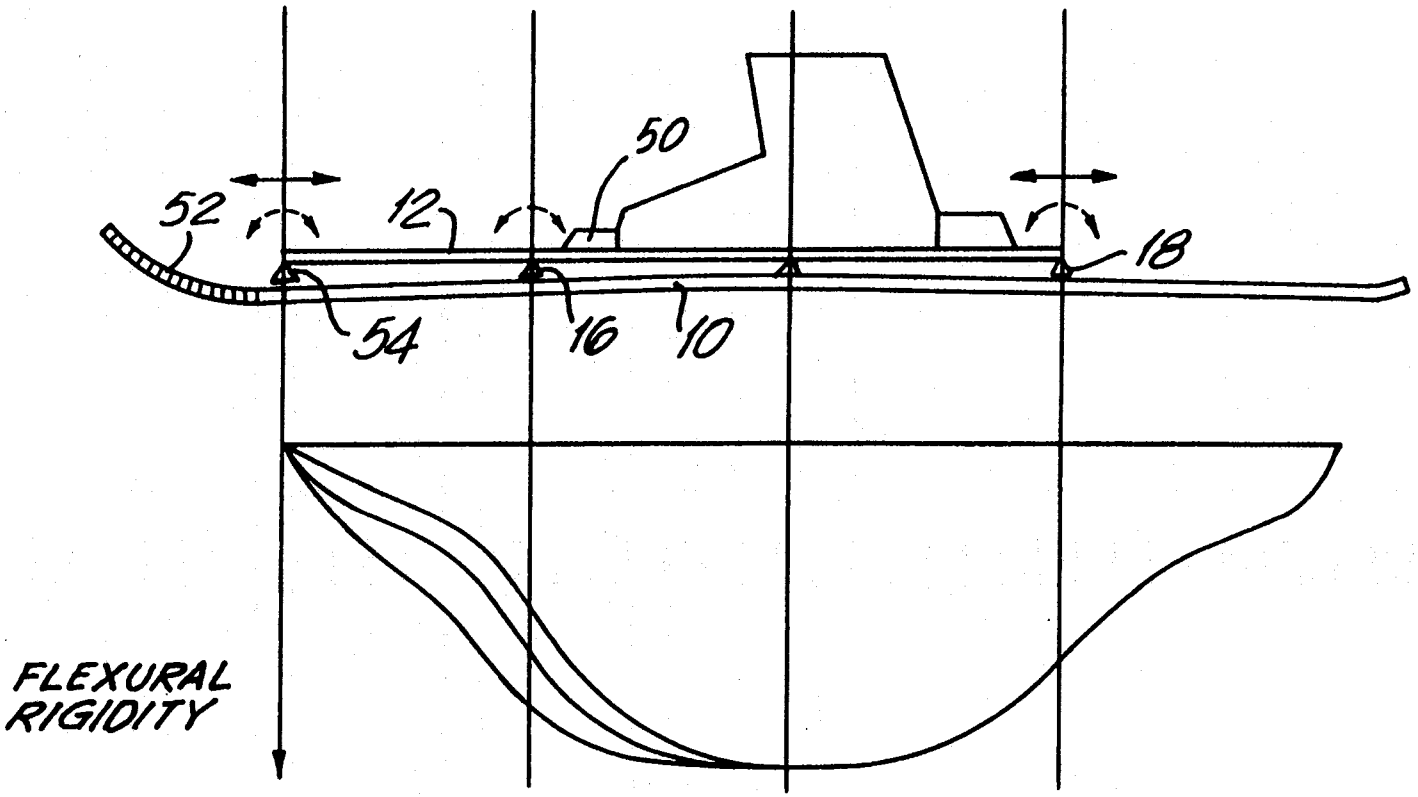

In the working embodiment depicted in FIG. 9 the previously described working embodiment is modified since the plate 12 is lengthened and extends past bearing 16 towards the curved, shovel-shaped tip 52 of the ski. At the free end the plate 12 is additionally mounted on a bearing 54 to allow longitudinal sliding and pivotal motion. The structure of the bearing 54 may consequently, basically be the same as that of the bearing 18. Typical flexural rigidity characteristics for this working embodiment are indicated underneath the ski in FIG. 9. It will be clear from this that using suitable adjustment elements in the bearing 54 it is possible to change the flexural rigidity distribution adjacent to the shovel-shaped tip of the ski again.

Figure 10A:
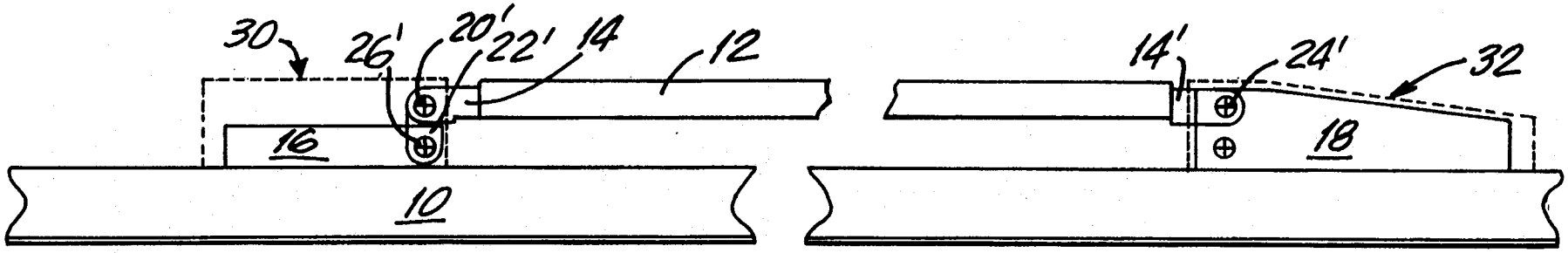
Figure 10B:
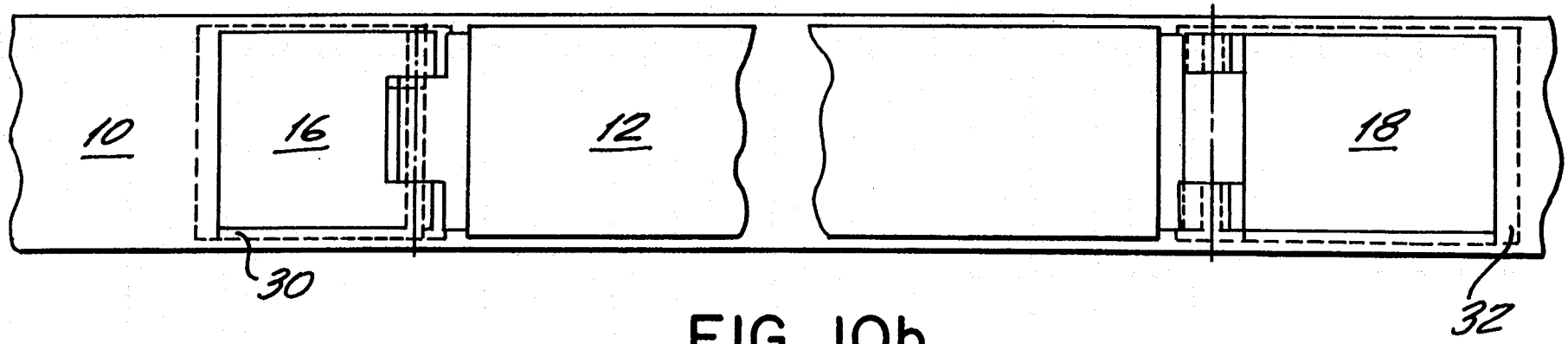

In the third working embodiment in accordance with FIGS. 10*a* and 10*b*, departing from the first working embodiment, the plate 12 is mounted upside down. This means that the bearing part 14' is fitted in the upper hole in the bearing 18 using a pin 24', whereas the bearing part 14 of the plate 12 is pivoted on a pin 20' to the side of the pivotal lever 22', which is turned away from the surface of the ski. The end, extending towards the body of the ski, of the lever 22' is pivoted using the pin 26' in the bearing 16. The cover hood 30 of the bearing 16 is made taller than in the working embodiment depicted in FIG. 6. In the case of this working embodiment, the plate 12 is spaced further for the surface of the ski by the length of the pivotal lever 22'. Accordingly the distance and, therefore, the arm of the lever is increased in size from the binding as far as the steel edge of the ski body 10.

In the working embodiments shown in the drawing one respective plate 12 is utilized which is triangular in plan view. On the other hand, it is possible for the distribution of flexural rigidity in the part adjacent to the binding to, furthermore, be modified by specially shaping the plate 12, for instance by having alternating narrower and broader parts. This means that the cross section of the plate varies along its length.

With the plate, in accordance with the invention provided, on the ski a replaceable system is created rendering it possible to very simply remove the plate and to arrange it on other, different skis. This is an advantage, for instance, when testing skis, or for ski equipment hire. Furthermore, there is certainly a large number of skiers who have more than one pair of skis and who by using such plate (on which the binding is permanently pre-mounted) simply mount the respective binding on the different type of ski. Other advantages of this readily removable system are that the skis may be more easily shipped and stored, because the plate with the binding may be easily removed in such a case.

With a ski in accordance with the invention, it is possible for the stiffening of the ski in the part adjacent to the binding to be systematically changed and, for instance, set to suit the conditions of the ski for descent of a slope or for the ability of the skier.

Moreover, it is possible for the damping characteristics of the binding and, consequently the handling properties of the ski, to be improved. Finally, a ski according to the invention now provides a very simple way of changing the distance of the plate from the ski, the bearings 16 and 18 possibly being provided with several holes arranged one above the other to receive the pivot pins as described hereinabove.

What is claimed is:

1. A ski having a body, first and second bearing assemblies fixedly secured to an upper surface of the body, a longitudinally extending plate having first and second coupling elements secured to opposite ends thereof, means for pivotally connecting said first coupling element to said first bearing assembly, a pivot lever having one end pivotally connected to said second coupling element and an opposite end pivotally connected to said second bearing assembly, a pin supported for longitudinal movement by said second bearing assembly and longitudinally aligned with said second coupling element, one end of said pin being in abutting engagement with said second coupling element and with said one end of said pivot lever, and adjustable spring means for directing a longitudinal force against an opposite end of said pin.

2. A ski according to claim 1 wherein the spring means is a helical spring and the tension of the helical spring is adjustable by means of a screw located in the second bearing assembly.

3. A ski according to claim 1 wherein the pin consists of an elastic material.

4. A ski according to claim 1 wherein an elastomeric element is located beween the longitudinally extending plate and the upper surface of the ski body.

5. A ski according to claim 1 wherein the longitudinally extending plate has different cross sections along the longitudinal length thereof.

* * * * *